US011684161B1

(12) United States Patent
Chen

(10) Patent No.: US 11,684,161 B1
(45) Date of Patent: Jun. 27, 2023

(54) PORTABLE BLEACHER CHAIR

(71) Applicant: Chunying Chen, Jiujiang (CN)

(72) Inventor: Chunying Chen, Jiujiang (CN)

( * ) Notice: Subject to any disclaimer, the term of this patent is extended or adjusted under 35 U.S.C. 154(b) by 0 days.

(21) Appl. No.: 17/988,200

(22) Filed: Nov. 16, 2022

(30) Foreign Application Priority Data

Oct. 28, 2022 (CN) ..... 202222857700.5

(51) Int. Cl.
*A47C 1/16* (2006.01)

(52) U.S. Cl.
CPC ..... *A47C 1/16* (2013.01)

(58) Field of Classification Search
CPC .... A47C 1/16; A47C 1/00; A47C 4/28; A47C 4/00; A47C 4/02; A47C 4/024; A47C 4/025; A47C 4/027; A47C 4/028; A47C 4/03; A47C 4/286; A47C 4/30
See application file for complete search history.

(56) References Cited

U.S. PATENT DOCUMENTS 633,012 A * 9/1899 Kidd et al. ..... A47C 1/16 297/380
859,560 A * 7/1907 Hyde ..... A47C 1/16 297/352
1,293,778 A * 2/1919 Holm ..... A47C 1/16 297/352
1,809,392 A * 6/1931 Ponten ..... A47C 1/16 297/252
1,963,835 A * 6/1934 Deland ..... A47C 9/10 297/51
2,518,971 A * 8/1950 Zillig ..... B63B 17/00 297/352
2,542,820 A * 2/1951 Legois ..... A47C 1/16 297/352
2,957,515 A * 10/1960 Gibson ..... A47C 1/16 297/440.11
3,026,142 A * 3/1962 Holloway ..... A47C 1/16 297/352
3,066,980 A * 12/1962 Clute ..... A47C 1/16 297/352
5,069,503 A * 12/1991 Martinez ..... A47C 1/146 297/378.12
5,829,837 A * 11/1998 Reiersen ..... A47C 7/42 297/352
6,502,902 B1 * 1/2003 Romero ..... A47C 1/16 297/352
7,631,934 B2 * 12/2009 Mac Isaac ..... A47C 1/16 297/352
7,641,276 B1 * 1/2010 Chen ..... A47C 4/286 297/42
9,247,817 B2 * 2/2016 Grace ..... A47C 4/04
10,531,742 B2 * 1/2020 Reed ..... A47C 7/008
(Continued)

*Primary Examiner* — James M Ference

(57) ABSTRACT

The portable bleacher chair provided by the present disclosure includes a base and a backrest rotatably connected to amend of the base. The base includes a pair of main rods arranged in parallel and a foldable assembly connected between the pair of main rods. The foldable assembly is configured to be in a folded state or an unfolded state, and a distance between the pair of main rods varies with a transition between the folded state and the unfolded state of the foldable assembly. Since the base includes the foldable assembly, the portable bleacher chair provided by the present disclosure is small, compact, and easy to carry in the folded state.

9 Claims, 2 Drawing Sheets

(56) References Cited

U.S. PATENT DOCUMENTS

| | | | | |
|---|---|---|---|---|
| 10,881,211 | B1 * | 1/2021 | Al-Salloom | A47C 4/04 |
| 2009/0212614 | A1 * | 8/2009 | Isaac | A47C 1/16<br>297/252 |
| 2011/0006565 | A1 * | 1/2011 | Lougee | A61G 5/08<br>297/16.1 |
| 2011/0018312 | A1 * | 1/2011 | Grace | A47C 4/045<br>297/16.2 |
| 2014/0138990 | A1 * | 5/2014 | Chesness | A47C 4/286<br>297/16.1 |
| 2017/0202355 | A1 * | 7/2017 | Reed | A47C 1/16 |
| 2019/0216222 | A1 * | 7/2019 | Winterhalter | A47C 4/286 |
| 2019/0365104 | A1 * | 12/2019 | Frankel | A47C 4/30 |
| 2020/0281356 | A1 * | 9/2020 | Yang | A47C 5/10 |

* cited by examiner

PORTABLE BLEACHER CHAIR

CROSS REFERENCE TO RELATED APPLICATION

This application claims priority benefit of Chinese Utility Model Application No. 202222857700.5, filed on Oct. 28, 2022, and the entire contents of which are incorporated herein by reference.

TECHNICAL FIELD

The present disclosure relates to the technical field of leisure goods, and in particular to a portable bleacher chair.

BACKGROUND

Stepped bleachers are mostly set up in indoor stadiums or outdoor stadiums for unspecified users, such as spectators watching games. To increase comfort when sitting in the bleachers, the spectators may bring their own bleacher chairs, which are placed in the bleachers. The bleacher chair includes a base, a backrest, and armrests, and the spectator can sit on the bleacher chair without having to touch the hard and cold bleacher while enjoying the comfort of sitting in the chair and watching the game.

To facilitate the portability, the market appeared foldable bleacher chairs. However, the conventional foldable bleacher chair can only fold the backrest and base relative to each other, such that the volume is still large even after folding.

SUMMARY OF THE DISCLOSURE

Based thereon, it is necessary to propose a portable bleacher chair with a compact structure.

The present disclosure provides a portable bleacher chair, including a base and a backrest rotatably connected to an end of the base, the base including a pair of main rods arranged in parallel and a foldable assembly connected between the pair of main rods; wherein the foldable assembly is configured to be in a folded state or an unfolded state, and a distance between the pair of main rods varies with a transition between the folded state and the unfolded state of the foldable assembly.

In some embodiments, each main rod defines a slide groove, and the foldable assembly includes two X-shaped cross structures arranged side by side and a telescopic rod arranged between the two X-shaped cross structures; each X-shaped cross structure includes a first end and a second end connected to the telescopic rod, and a third end and a fourth end connected to a corresponding main rod; the third end is fixed to the main rod, and the fourth end is slidable in the slide grove; the telescopic rod includes a telescopic locking structure.

In some embodiments, an end of the telescopic rod is arranged with a first knob.

In some embodiments, each X-shaped cross structure further includes an inner rod and an outer rod that are pivotally connected, with the inner rod received in the outer rod in the folded state.

In some embodiments, the backrest includes a pair of vertical rods, each fixed to a corresponding main rod, and a horizontal rod connected between the pair of vertical rods.

In some embodiments, the horizontal rod includes a first crossbar connected to one of the pair of vertical rods, a second crossbar connected to the other of the pair of vertical rods, and a connection portion arranged between the first crossbar and the second crossbar.

In some embodiments, the connection portion includes a first receiving slot, a second receiving slot, and a second knob arranged between the first receiving slot and the second receiving slot; the first crossbar is rotatably connected to the first receiving slot, and the second crossbar is rotatably connected to the second receiving slot.

In some embodiments, an end of each vertical rod connected to a corresponding main rod is arranged with a stop.

In some embodiments, each main rod includes a main part connected to the foldable assembly and a fixed part arranged on the main part; the backrest is rotatably connected to the fixed part.

In some embodiments, a side of each main rod away from the foldable assembly is arranged with a hook rotatably connected to the each main rod.

The portable bleacher chair provided by the present disclosure includes a base and a backrest rotatably connected to an end of the base. The base includes a pair of main rods arranged in parallel and a foldable assembly connected between the pair of main rods. The foldable assembly is configured to be in a folded state or an unfolded state, and a distance between the pair of main rods varies with a transition between the folded state and the unfolded state of the foldable assembly. Since the base includes the foldable assembly, the portable bleacher chair provided by the present disclosure is small, compact, and easy to carry in the folded state.

BRIEF DESCRIPTION OF THE DRAWINGS

In order to more clearly illustrate the technical solutions in specific embodiments or prior art of the present disclosure, the following is a brief description of the accompanying drawings that need to be used in the description of the specific embodiments or prior art. It is obvious that the accompanying drawings in the following description are some embodiments of the present disclosure, and for those skilled in the art, other accompanying drawings may be obtained from these drawings without creative effort.

DETAILED DESCRIPTION

The following will be a clear and complete description of the technical solution of the present disclosure in conjunction with the accompanying drawings. Obviously, the described embodiments are a part of the embodiments of the present disclosure, not all of them. Based on the embodiments in the present disclosure, all other embodiments obtained by those skilled in the art without making creative labor belong to the scope of the present disclosure.

In the description of the present disclosure, it should be noted that the terms "center", "up", "down", "left", "right ", "vertical", "horizontal", "inside", "outside", etc., where appearing, indicate an orientation or positional relationship based on the orientation or positional relationship shown in the attached drawings, and are intended only to facilitate and simplify the description of the present disclosure, not to indicate or imply that the device or element referred to must have a particular orientation, be constructed and operate in a particular orientation, and therefore cannot be construed as limiting the present disclosure. In addition, the terms "first", "second", and "third" are intended for descriptive purposes only and are not to be construed as indicating or implying relative importance.

Figure 1:
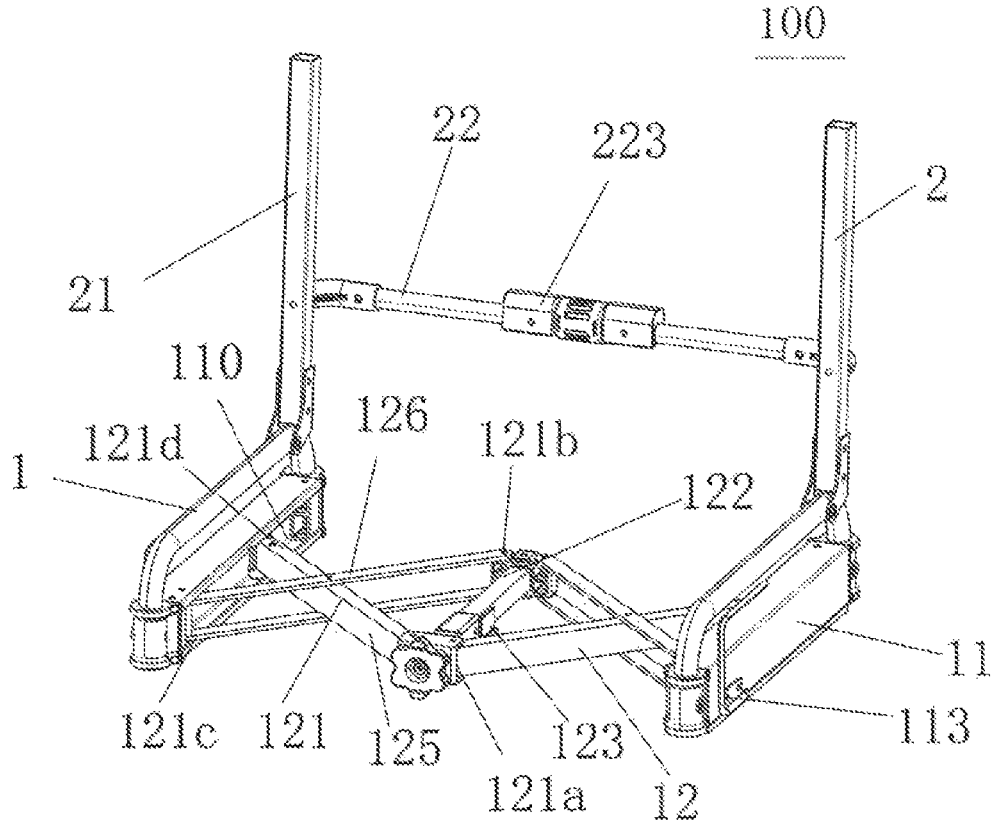
FIG. 1 is a structural schematic view of a portable bleacher chair in an unfolded state according to an embodiment of the present disclosure.
Figure 2:
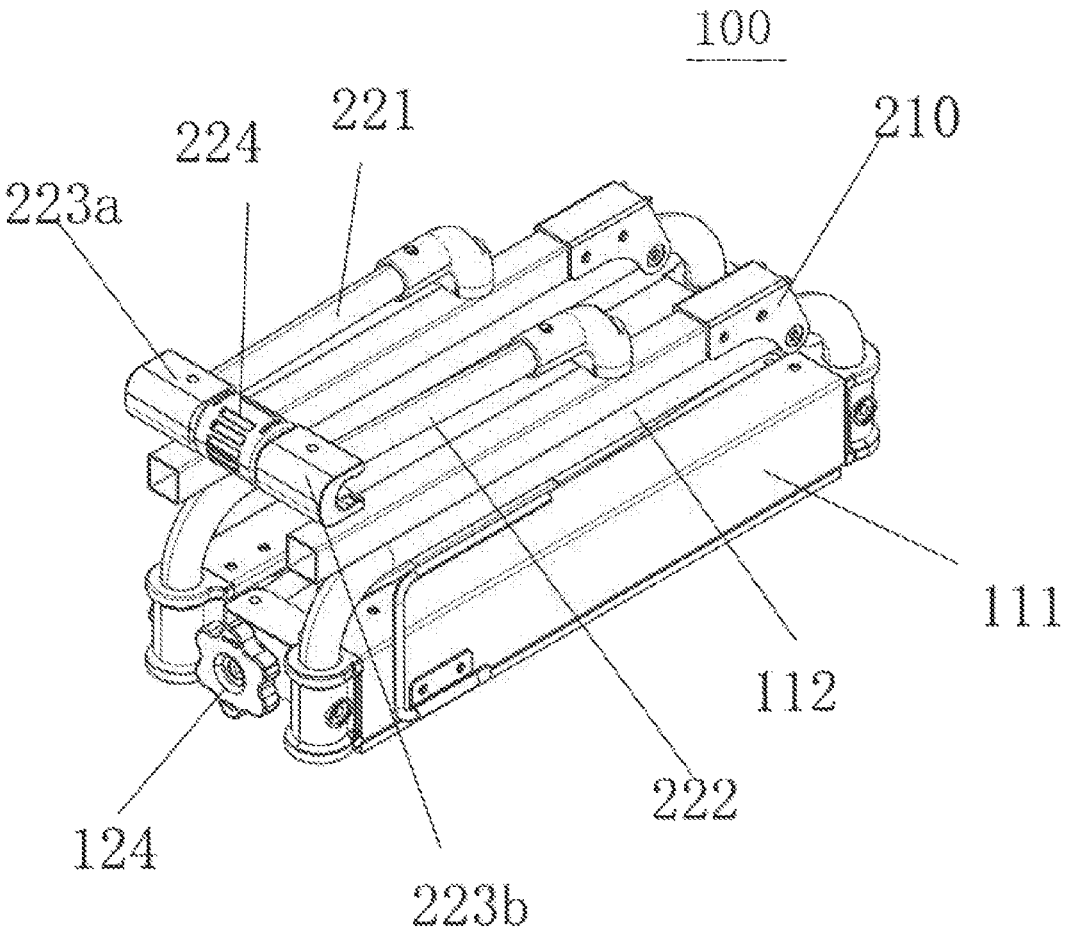
FIG. 2 is a structural schematic view of a portable bleacher chair in a folded state according to an embodiment of the present disclosure.

As shown in FIGS. 1 and 2, the present disclosure provides a portable bleacher chair 100 including a base 1 and a backrest 2 rotatably connected to an end of the base 1, the base 1 including a pair of main rods 11 arranged in parallel and a foldable assembly 12 connected between the pair of main rods 11. The foldable assembly 12 is configured to be in a folded state or an unfolded state, and a distance between the pair of main rods 11 varies with the foldable assembly 12 in the folded state and the unfolded state. Specifically, in the unfolded state, the distance between the pair of main rods 11 is D, and in the folded state, the distance between the pair of main rods 11 is d, and D>d.

Each main rod 11 defines a slide groove 110, and the foldable assembly 12 includes two X-shaped cross structures 121 arranged side by side and a telescopic rod 122 arranged between the two X-shaped cross structures 121. Each X-shaped cross structure 121 includes a first end 121*a* and a second end 121*b* connected to the telescopic rod 122, and a third end 121*c* and a fourth end 121*d* connected to a corresponding main rod 11. The third end 121*c* is fixed to the main rod 11, and the fourth end 121*d* is slidable in the slide grove 110. The telescopic rod 122 includes a telescopic locking structure 123.

In the embodiments, the third end 121*c* is fixed at an end of the corresponding main rod 11 away from the backrest 2, and the slide groove 110 extends from another end of the main rod 11 near the backrest 2 to the middle of the main rod 11. When the fourth end 121*d* slides to an end of the slide groove 110 near the backrest 2, the foldable assembly 12 reaches the folded state; when the fourth end 121*d* slides to another end of the slide groove 110 away from the backrest 2, the foldable assembly 12 reaches the unfolded state. In the folded state, the telescopic rod 122 is elongated; and in the unfolded state, the telescopic rod 122 is shortened. The state of the foldable assembly 12 can be fixed by fixing the length of the telescopic rod 122 through the telescopic locking structure 123. It will be appreciated that the third end 121*c* and the fourth end 121*d* are interchangeable, and the slide groove 110 may extend from the end of the main rod 11 away from the backrest 2 to the middle of the main rod 11.

Each X-shaped cross structure 121 further includes an inner rod 125 and an outer rod 126 that are pivotally connected, with the inner rod 125 received in the outer rod 126 in the folded state.

An end of the telescopic rod 122 is arranged with a first knob 124, which is threaded to the telescopic rod 122 for fine-tuning the length of the telescopic rod 122. When a seat cloth (not shown) is sleeved on the main rods 11 of the base 1, the first knob 124 may be rotated to adjust the distance between the pair of main rods 11 by slightly adjusting the length of the telescopic rod 122, so as to tense or relax the seat cloth. In the embodiments, the first knob 124 is disposed at an end of the telescoping rod 122 near the third end 121*c*, which facilitates the user to adjust the first knob 124 from the front after unfolding the bleacher chair 100. It can be understood that the first knob 124 may alternatively be disposed at another end of the telescoping rod 122 away from the third end 121*c*, such that the user can adjust the first knob 124 from the rear of the bleacher chair 100.

Further, the backrest 2 includes a pair of vertical rods 21, each fixed to a corresponding main rod 11, and a horizontal rod 22 connected between the pair of vertical rods 21.

The horizontal rod 22 includes a first crossbar 221 connected to one of the pair of vertical, rods 21, a second crossbar 222 connected to the other of the pair of vertical rods 21, and a connection portion 223 arranged between the first crossbar 221 and the second crossbar 222.

Specifically, the connection portion 223 includes a first receiving slot 223*a*, a second receiving slot 223*b*, and a second knob 224 arranged between the first receiving slot 223*a* and the second receiving slot 223*b*. The first crossbar 221 is rotatably connected to the first receiving slot 223*a*, and the second crossbar 222 is rotatably connected to the second receiving slot 223*b*.

As the foldable assembly 12 moves, a distance between the pair of vertical rods 21 varies between the folded state and the unfolded state. In the folded state, the first crossbar 221 is perpendicular to the first receiving slot 223*a* and the second crossbar 222 is perpendicular to the second receiving slot 223*b*, with the first crossbar 221 and the second crossbar 222 parallel to each other. In the unfolded state, the first crossbar 221 is parallel to the first receiving slot 223*a* and the second crossbar 222 is parallel to the second receiving slot 223*b*, with the first crossbar 221 and the second crossbar 222 disposed substantially in the same line.

The second knob 224 is reversely threaded to the first holding slot 223*a* and the second holding slot 223*b*, respectively. By turning the second knob 224 in one direction, the first receiving slot 223*a* and the second receiving slot 223*b* move close to each other, and the length of the horizontal rod 22 shortens. By turning the second knob 224 in the opposite direction, the first receiving slot 223*a* and the second receiving slot 223*b* move away from each other, and the length of the horizontal rod 22 grows. When a backrest cloth (not shown) is sleeved on the vertical rods 21 of the backrest 2, the second knob 224 may be rotated to adjust the distance between the pair of vertical rods 21 by slightly adjusting the length of the horizontal rod 22, thereby tensing or relaxing the backrest cloth.

An end of each vertical rod 21 connected to a corresponding main rod 11 may be arranged with a stop 210 configured to limit a rotation angle of the vertical rod 21.

In the embodiments, each main rod 11 includes a main part 111 connected to the foldable assembly 12 and a fixed part 112 arranged on the main part 111. The backrest 2 is rotatably connected to the fixed part 112, and the seat cloth (not shown) is spanned by the fixed part 112. A side of the main rod 11 away from the foldable assembly 12 is arranged with a hook 113 rotatably connected to the main rod 11, and the hook 113 is configured to hook a bottom part of a bleacher such that the bleacher chair 100 is fixed relative to the bleacher.

The portable bleacher chair provided by the present disclosure includes a base 1 and a backrest 2 rotatably connected to an end of the base 1. The base 1 includes a pair of main rods 11 arranged in parallel and a foldable assembly 12 connected between the pair of main rods 11. The foldable assembly 12 is configured to be in a folded state or an unfolded state, and a distance between the pair of main rods 11 varies with a transition between the folded state and the unfolded state of the foldable assembly 12. Since the base 1 includes the foldable assembly 12, the portable bleacher chair 100 provided by the present disclosure is small, compact, and easy to carry in the folded state.

The above embodiments are only intended to illustrate the technical solution of the present disclosure, not to limit it; despite the detailed description of the present disclosure with reference to the preceding embodiments, those skilled in the art should understand: it is still possible to modify the technical solution recorded in the preceding embodiments, or to replace some or all of the technical features therein with equivalent ones; and these modifications or replacements do not make the essence of the corresponding technical solutions out of the scope of the technical solutions in the embodiments of the present disclosure.

What is claimed is:

1. A portable bleacher chair, comprising a base and a backrest rotatably connected to an end of the base, the base comprising a pair of main rods arranged in parallel and a foldable assembly connected between the pair of main rods; wherein the foldable assembly is configured to be in a folded state or an unfolded state, and a distance between the pair of main rods varies with a transition between the folded state and the unfolded state of the foldable assembly;

each main rod of the pair of main rods defines a slide groove, and the foldable assembly comprises two X-shaped cross structures arranged side by side and a telescopic rod arranged between the two X-shaped cross structures; each X-shaped cross structure of the two X-shaped cross structures comprises a first end, a second end, a third end and a fourth end; the first end and the second end are connected to the telescopic rod; the third end is fixed to a corresponding main rod of the pair of main rods, and the fourth end is slidable in the slide grove; the telescopic rod comprises a telescopic locking structure.

2. The portable bleacher chair according to claim 1, wherein an end of the telescopic rod is arranged with a first knob.

3. The portable bleacher chair according to claim 2, wherein the backrest comprises a pair of vertical rods and a horizontal rod connected between the pair of vertical rods; one of the pair of vertical rods is fixed to one of the pair of main rods, another of the pair of vertical rods is fixed to another of the pair of main rods.

4. The portable bleacher chair according to claim 3, wherein the horizontal rod comprises a first crossbar connected to one of the pair of vertical rods, a second crossbar connected to an other of the pair of vertical rods, and a connection portion arranged between the first crossbar and the second crossbar.

5. The portable bleacher chair according to claim 4, wherein the connection portion comprises a first receiving slot, a second receiving slot, and a second knob arranged between the first receiving slot and the second receiving slot; the first crossbar is rotatably connected to the first receiving slot, and the second crossbar is rotatably connected to the second receiving slot.

6. The portable bleacher chair according to claim 3, wherein an end of each vertical rod of the pair of vertical rods is arranged with a stop.

7. The portable bleacher chair according to claim 1, wherein each X-shaped cross structure of the two X-shaped cross structures further comprises an inner rod and an outer rod that are pivotally connected, with the inner rod received in the outer rod in the folded state.

8. The portable bleacher chair according to claim 1, wherein each main rod of the pair of main rods comprises a main part connected to the foldable assembly and a fixed part arranged on the main part; the backrest is rotatably connected to the fixed part.

9. The portable bleacher chair according to claim 1, wherein a side of each main rod of the pair of main rods away from the foldable assembly is arranged with a hook rotatably connected to each main rod of the pair of main rods.

* * * * *